US008191679B2

(12) United States Patent
Smith

(10) Patent No.: US 8,191,679 B2
(45) Date of Patent: Jun. 5, 2012

(54) SAFETY STRAP ASSEMBLY FOR TREE CLIMBERS

(76) Inventor: Robert Benjamin Smith, White Hall, MD (US)

( * ) Notice: Subject to any disclaimer, the term of this patent is extended or adjusted under 35 U.S.C. 154(b) by 217 days.

(21) Appl. No.: 12/840,261

(22) Filed: Jul. 20, 2010

(65) Prior Publication Data

US 2012/0018250 A1 Jan. 26, 2012

(51) Int. Cl.
*A62B 35/00* (2006.01)

(52) U.S. Cl. ..... 182/9

(58) Field of Classification Search ..... 182/9
See application file for complete search history.

(56) References Cited

U.S. PATENT DOCUMENTS

| | | | | |
|---|---|---|---|---|
| 2,381,114 | A * | 8/1945 | Cox | 182/9 |
| 2,920,714 | A | 1/1960 | Johnson | |
| 3,407,898 | A | 10/1968 | Johnson | |
| 4,579,196 | A | 4/1986 | Allen et al. | |
| 4,712,646 | A * | 12/1987 | Page | 182/9 |
| 4,923,048 | A | 5/1990 | Cole | |
| 4,951,778 | A | 8/1990 | Halvorson | |
| 5,052,514 | A | 10/1991 | Rezmer | |
| 5,141,074 | A * | 8/1992 | Sulowski et al. | 182/9 |
| 5,184,696 | A * | 2/1993 | Meed et al. | 182/9 |
| 6,082,492 | A | 7/2000 | Yerger | |
| 6,241,045 | B1 | 6/2001 | Reeve et al. | |
| 6,357,547 | B1 * | 3/2002 | Kellog et al. | 182/9 |
| 6,644,438 | B1 | 11/2003 | Chang et al. | |
| 6,752,242 | B1 * | 6/2004 | Whitehead et al. | 182/9 |
| 6,981,571 | B2 * | 1/2006 | Diggle | 182/9 |
| 7,036,628 | B2 | 5/2006 | Wilcox et al. | |
| 2010/0051382 | A1 * | 3/2010 | Schlief | 182/9 |
| 2010/0078261 | A1 * | 4/2010 | Watts et al. | 182/9 |

* cited by examiner

*Primary Examiner* — Alvin Chin Shue
(74) *Attorney, Agent, or Firm* — Louis Ventre, Jr.

(57) ABSTRACT

A safety strap assembly is used by a climber for ascending, remaining secured at height and descending from a tree or pole. The safety strap assembly includes a tubular strap; an elastic strap; a stiffening member; a string; a coupling; and a finger-pull. Optionally, an oval chain-link is included. The tubular strap fits around a tree. One end of the tubular strap is connected to an elastic strap. The other end is attachable to the climber. The stiffening member fits within the tubular member. A string extending from two holes in the tubular strap permit the stiffening member to be shifted. The coupling at the free end of the elastic strap connects to the tubular strap in a removable slidable engagement. The finger-pull at that connection breaks away if the climber falls enabling the tubular strap to engage the tree and prevent a fall to the ground.

6 Claims, 3 Drawing Sheets

SAFETY STRAP ASSEMBLY FOR TREE CLIMBERS

TECHNICAL FIELD

In the field of torso harnesses, a tree or pole encircling safety strap assembly intended to be attached to, and positioned by, a person when climbing, maintaining position on the tree or pole, and descending therefrom providing a means to prevent falling.

BACKGROUND ART

Hunters, particularly bow hunters, often find a need to climb a tree and hold position at an elevation above the ground when hunting large game animals, such as deer. Wildlife photographers, utility repairmen and tree conservationists, among others, also have occasion to climb a tree and pole. For simplicity of discussion, a tree is used herein with the understanding that the discussion applies equally to a pole and a hunter is used as the climber, although it may be any person having a need to climb. In all cases, climbing, descending and activities at height above the ground all hold a potential for losing grip or balance and subsequently falling. Thus, straps or ropes of various kinds have been used in assisting in one or more of these activities.

Some such straps have particular application after the climb. In order to provide fall protection some belts have built-in teeth that bite into a tree when a person falls. An example is U.S. Pat. No. 5,184,696 (the '696 patent) for a fall arrest belt assembly that attaches to the body belt of a climber who climbs wooden utility poles or trees. The belt assembly has an outer strap to fit around the pole, an elastic cross strap to pull the outer belt against the pole, and a safety device on the outer strap. The safety device has a large tooth that is normally latched in a recessed or closed position. If the climber falls, a barb on the tooth pulls the tooth to an open position, assisted by a spring which helps deploy the tooth and hold it open. The tooth penetrates the pole and prevents falling. A pair of balls on the cross strap prevent abrasion of the cross strap on the pole.

SUMMARY OF INVENTION

A safety strap assembly is used by a climber for ascending, remaining secured at height and descending from a tree or pole. The safety strap assembly is used with a suitable body safety harness or safety belt worn by the climber of a tree or pole, and is operable with one hand.

The safety strap assembly includes a tubular strap, preferably of nylon webbing, that is of sufficient size to fit around a tree or pole. One end of the tubular strap is connected to an elastic strap, preferably using oval chain-link. The opposite end of the tubular strap is attachable to the climber's harness, and it is this end that enables one-handed movement of the strap up or down the tree.

A thin stiffening member is inserted in the tubular member and this is preferably a hard but bendable nylon that maintains a roundish shape to the strap. Two holes in the tubular strap permit a string to be attached to the stiffening member so that the stiffening member can be shifted to give more or less flexibility at the end of the tubular strap, which accommodates differing tree sizes and climber stances next to the tree.

A coupling at the free end of the elastic strap holds an oval chain-link having a prong extension or offset from the oval chain-link. The prong slides over the tubular strap across the width of the tubular strap in a slidable engagement between the prong and a portion of the oval chain link.

A finger-pull at the connection between the tubular strap and the elastic strap enables the climber to hold that connection while operating the strap with the same hand, yet break away from the connection if the climber falls. Thus, the finger-pull releases from the tubular strap if the climber falls while holding this connection.

Preferably, part of the connection means at the end of each strap is a simple fold-over of the strap material, forming a connection loop useful with common connecting links.

The releasable connection formed by the finger-pull is preferably an oval chain link, the oval chain link comprising a nut that opens the oval chain link. The nut fits within the connection loop at that tubular strap end and this is surrounded by a wire frame that forms the finger-pull.

Optionally, the prong that enables a quick slip-on connection of the elastic strap to the tubular strap also includes a closable link between the prong and the oval chain-link, which prevents inadvertent removal of the elastic strap from the slidable engagement. This closable link may be spring loaded and biased to a closed position.

Technical Problem

Presently existing safety attachment devices are hard to move while climbing a tree: the larger the tree, the more effort is required to move existing devices.

Present safety belts or straps are mostly a soft rope or a strap that takes two hands to move and adjust, and must be retightened after each movement.

Existing safety attachment devices are normally some type of rope or soft strap. Generally, these straps are to be put in place after a hunter has climbed the tree, rather than prior to starting the climb. Use of these straps subsequent to climbing is primarily due to the extra effort required to move the strap while climbing.

Generally, existing straps are left in place while in a tree stand and again removed when climbing down. They do not permit the hunter to climb down from the tree with the strap attached.

Linesmen straps are used for climbing, but not as a safety attachment or strap. These provide limited fall protection. They can slip with a falling climber. They do not self adjust as you climb and cannot be moved with one hand.

Because climbing a tree is an arduous task, doing it with the existing types of safety straps around the tree can be an arduous, and sometimes frustrating, task in manipulating the strap to slide easily up and down a tree. Many forego the arduous task of using a strap while ascending or descending a tree because of the difficulties involved.

When used during the climb and descent, existing straps that are designed for use while climbing, present a fall vulnerability because the strap needs to be loose enough to permit its travel without entangling against the tree on the side opposite the climber. If it is loose, however, today's straps can also slip down the tree with a falling climber.

Solutions like the '696 patent, noted above, add heavy latching devices that require affirmative human action to engage, require sliding means on the tree surface to permit movement but which add frictional resistance to the climb, and include a tooth or spike that can cause inadvertent injury, for example when lifted or carried.

Solution to Problem

The solution is a tree climbing safety strap or belt to be attached to the tree then attached to a suitable body safety harness. The safety strap is a secure attachment to prevent the user from falling when climbing a tree, while in a tree stand and while descending from the tree for hunting, but may be used for other activities and while climbing other similarly shaped objects.

The solution is a strap that is semi-rigid in order to easily raise and lower it with one hand while in use around a tree and automatically retightens by itself.

The solution is a strap that is automatically engaged against the tree in the event a climber slips, which prevents a fall to the ground. In other words, it is self tightening in the event of a fall.

The solution is a strap that is adjustable once at height so that a Hunter can remain comfortably in position while also secured to the tree.

The solution is a strap is easily stored despite being semi rigid in use.

The solution is a strap that is lightweight, involves no risk of injury from protruding spikes while in storage or being carried.

The solution is a strap that is easily conveyed to the climbing location, and quickly deployed in its use.

Advantageous Effects Of Invention

The safety strap assembly is usable with one hand and provides fall protection by automatically engaging with the tree or pole in the event a climber falls. It may be used for ascending, remaining secured at height and descending from a tree or pole.

The safety strap assembly includes a finger-pull, which is designed to pull out during a fall as a safety feature. The finger-pull enables reengagement of the tubular strap with the tree before, after or during movement of the tubular strap up or down the tree. This releasing or disengagement feature prevents the climber from interfering with the capability of tubular strap to tighten on the tree in a fall situation.

BRIEF DESCRIPTION OF DRAWINGS

The drawings illustrate preferred embodiments of the safety strap assembly, or components thereof, and the reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention or components thereof. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 7:
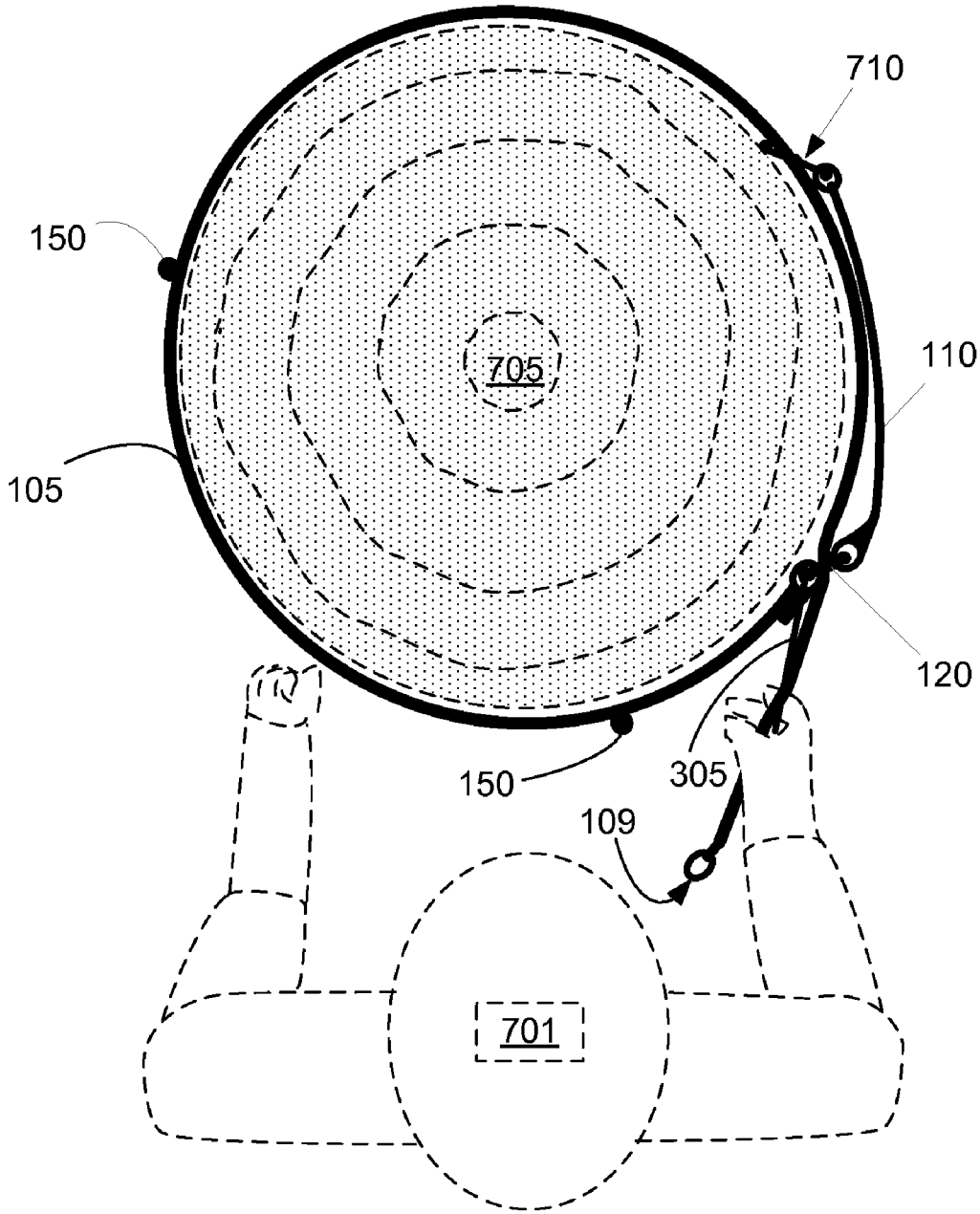
FIG. 7 is a top view of a climber using the safety strap assembly around a tree.

FIG. 7 illustrates a safety strap assembly in use around a tree (705) and being held and attached to a climber (701). The safety strap assembly is preferably used by a climber for ascending, remaining secured at height and descending from a tree or pole.

Figure 1:
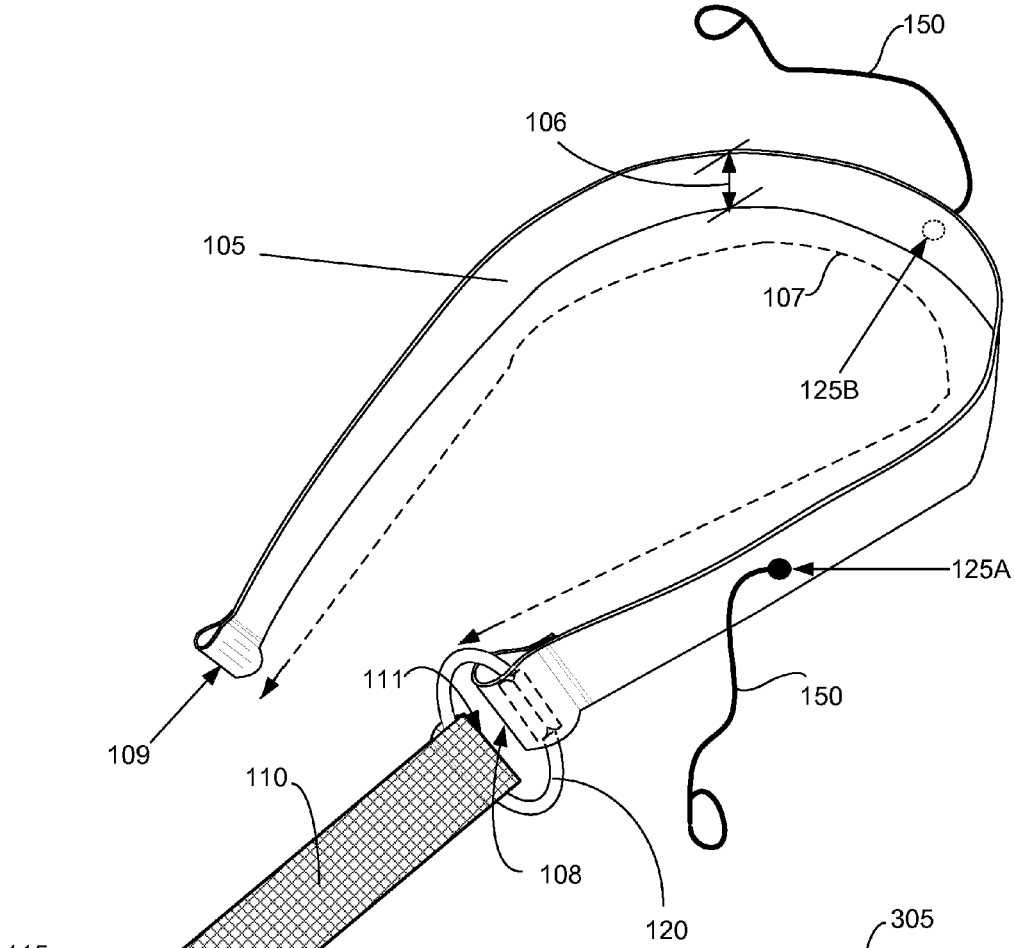
FIG. 1 is a perspective of a tubular strap connected to an elastic strap.

In reference to FIG. 1, the safety strap assembly includes a tubular strap (105); an elastic strap (110); a stiffening member (405); a string (150); a coupling (115); and a finger-pull (305). It optionally includes an oval chain-link (120).

The tubular strap (105) is preferably a pliable, nylon webbing readily commercially available and similar to seat belt material, except that it is tubular. Other materials, such as leather or other synthetic material are also possible.

The tubular strap (105) has a width (106) indicated by the double-headed arrow, a length (107) indicated by the dashed line with double-headed arrows, a first end (108), and an opposite end (109). While these are shown in FIG. 1 in a particular right hand or left handed sense, the first end (108) and the opposite end (109) may be reversed. Also, the tubular strap (105) can be used by either hand by just turning it 180 degrees, i.e., flipping it over.

The length (107) is adapted to fit around a tree (705) or pole, preferably with sufficient extra length to reach the climber (701) with one end, to with, the opposite end (109).

The first end (107) is adapted to connect to the elastic strap (110). A part of this adaptation is preferably a fold-over to form a connection loop. The fold-over is secured by stitching, a rivet, glue, melted together, or other means of securing known in the art. Another part of this adaptation is preferably, an oval chain link (120) comprising a nut (321) that opens the oval chain link (120), the nut (321) adapted to be fitted within the connection loop. Other direct or indirect connection means may be used.

The tubular strap (105) is configured to define two holes (125A and 125B) though a wall of the tubular strap (105). The hole at (125B) is shown as a dotted circle to indicate that it is on the opposite side of the tubular strap (105), as shown in FIG. 1, that is, the two holes are preferably on the same side of the tubular strap (105).

The opposite end (109) of the tubular strap (105) is configured for attachment to the climber (701). Such configuration may include a folded-over end to create an attachment loop at the end, or it may involve riveting to a hook, or it may involve adding a oval chain link within the loop, or it may involve any other configuration well known in the art for attaching one end of a strap to something else.

The stiffening member (405) slidably fits within the tubular strap (105). Thin nylon or plastic strips are commonly available for such purpose. The stiffening member (405) may be provided with an end taper across its width to facilitate sliding within the tubular strap (105). Two or more stiffening members (405) of reduced length may be used instead of one, to permit greater adjustment potential and reduce frictional resistance to movement within the tubular strap (105).

The string (150) is attached to the stiffening member (405) and adapted to extend out from the two holes (125A and 125B) such that pulling on the string (150) that extends from one hole (125A) moves the stiffening member (405) in one direction and pulling on the string (150) from the other hole (125B) moves the stiffening member (405) in the opposite direction. An alternative embodiment may include two strings (550A and 550B), each separately attached to the stiffening member (405). Alternative embodiments may include two or more stiffeners and a string attached to each, which may also require additional holes in the tubular strap (105).

The elastic strap (110) comprises an elastic-strap end (111) attached to the first end (108) of the tubular strap (105). The attachment may include folded-over ends to create attachment loops linked by an oval chain link (120), or it may involve riveting or sewing to the tubular strap (105), or it may involve any other attachment means well known in the art for attaching one end of a strap to another strap. The function of the elastic strap is to permit adjustment and self-tightening of the tubular strap (105).

Figure 2:
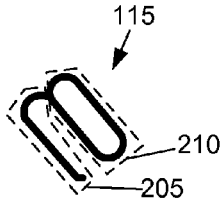
FIG. 2 is a plan view of a coupling.
Figure 3:
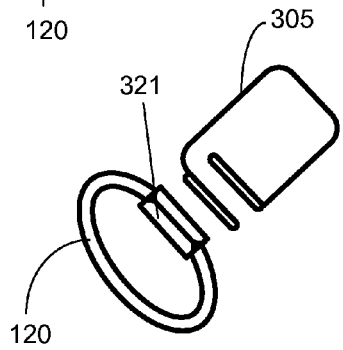
FIG. 3 is a plan view of an oval chain link with nut and wire frame finger-pull.
Figure 4:
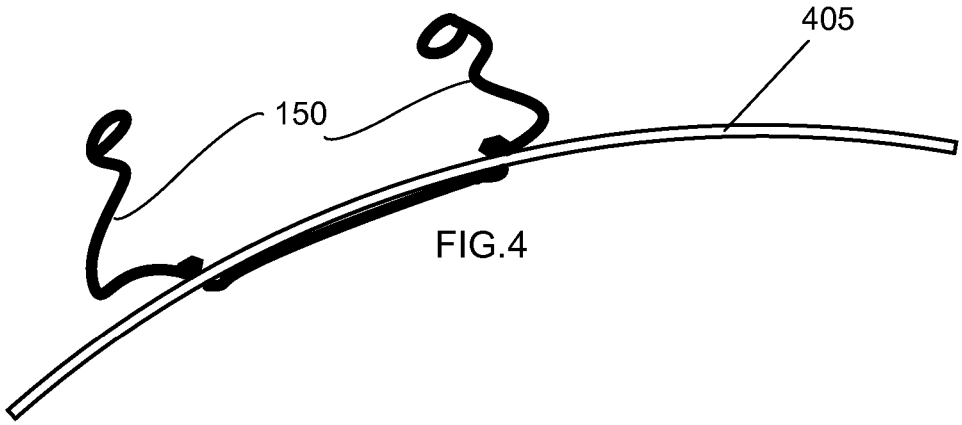
FIG. 4 is a side view of a stiffener and string.
Figure 5:
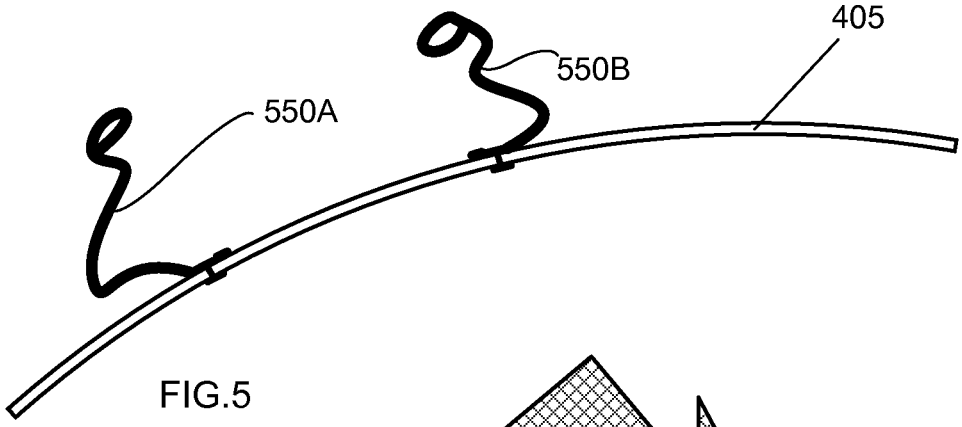
FIG. 5 is a side view of an alternative embodiment of stiffener and strings.
Figure 6:
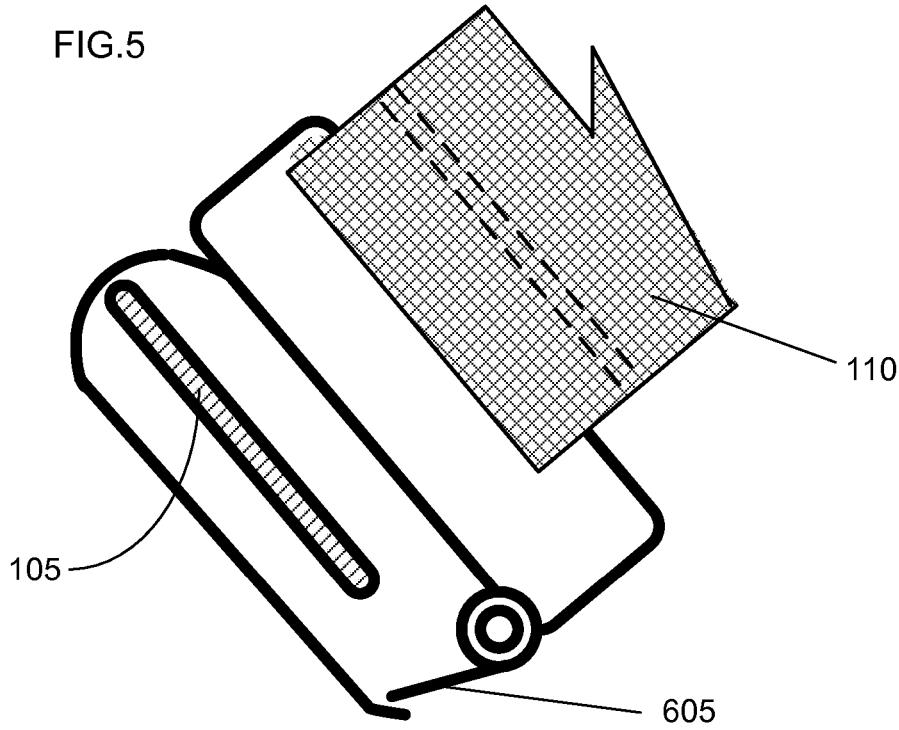
FIG. 6 is a plan view of a coupling with a closable link.

The elastic strap (110) further comprises a second-elastic-strap end (112) folded back on itself through a coupling (210), the coupling (115) approximately confined within a dashed enclosure in FIG. 2. This arrangement secures the coupling (115) to the elastic strap (110).

The coupling (115) is adapted to connect to the tubular strap (105) in a removable slidable engagement that maintains the tubular strap in a snug fit around the tree. One embodiment for the removable slidable engagement is a slidable adaptor on the tubular strap (105) that attaches to the coupling.

Another embodiment for the removable slidable engagement is a prong (205) offset from the link connector (210) and adapted to fit over the tubular strap (105) across the width (106) of the tubular strap (105) at a slidable engagement (710). The slidable engagement (710) is formed by the tubular strap lodged between the prong (205) and a portion of the link connector (210). The prong (205) being that part of the coupling (115) approximately confined within the other dashed enclosure in FIG. 2.

Optionally, a closable link (605) between the prong (205) and the link connector (210) is adapted to prevent inadvertent removal of the elastic strap (110) at the slidable engagement (710). Additionally, the closable link (605) may also be spring loaded and biased to a closed position.

The elastic strap (110) is adapted to maintain a closed snug fit around the tree when the coupling (115) is attached to the tubular strap (105) at the slidable engagement (710).

The finger-pull (305) is adapted to provide a hand hold for the climber (701) and may be considered a handle. The finger-pull (305) is further adapted to removably engage the first end (108) of the tubular strap (105). The finger-pull (305) is further adapted to release from first end (108) of the tubular strap (105) when a force is applied to it equal to a substantial portion of applied weight of the climber during a fall. A number of adaptations to enable these limitations are possible. One adaptation is a break-away handle, breaking off or yielding to a particular tensile or torsional stress.

The finger-pull (305) provides a means to apply a minimal force that can aid in opening the tubular strap sufficiently to move it up or down the tree using only one hand. The finger-pull (305) also helps the climber to center the tubular strap (105) on the slidable engagement (710) to reduce the chance of the tubular strap (105) slipping to one side or another on the coupling (115).

It is an important safety feature that the finger-pull (305) releases from the engagement with the first end (108) of the tubular strap (105) when a force is applied to it equal to a "substantial" portion of applied weight of the climber during a fall. The term "substantial" is intended to give some leeway for different size climbers and different tree sizes and thus safety strap assembly size, weight and manipulation force. For almost all applications, greater than about 25% of the weight of the climber would correspond to a substantial portion of the weight of the climber and enable sufficient leeway for expected variables. For example, a teenage climber might weigh 100 pounds and substantial for that climber would be 25 pounds or more. The purpose is to enable the finger-pull (305) to maintain engagement in normal safety strap assembly control while on the tree, but release with the weight of a falling climber holding on to the finger-pull (305). Under normal use and for most embodiments, the finger-pull (305) is not expected to be subjected to more than about 10 pounds of force acting to release the slidable engagement (710) or to otherwise manipulate the safety strap assembly.

In an embodiment with an oval chain link (120) comprising a nut (321), the preferred finger-pull comprises a wire-frame (305) that is adapted to releasably engage the nut (321). The wire-frame (305) is essentially a wire bent into an open-ended configuration with rectangular loops at the ends that are inserted into opposing sides at the first end (108) of the elastic strap (110). The rectangular loops engage the nut (321) within the within the connection loop.

EXAMPLE 1

A typical finished safety strap assembly is between about 48-68 inches long and about 2 inches wide. When one stiffening member (405) is used, it is preferably about 6 inches shorter than the tubular strap (105), to provide that amount of adjustment. When two stiffening members are used, each is preferably between about 22-32 inches long. The stiffening member (405) is about 0.062 to 0.11 inches thick, about 1.50 to 1.75 inches wide and tapers down in about the last 4 inches to about 1 inch in width. The tubular strap (105) with the stiffening member (405) installed is about 0.13 to 0.175 inches thick. Of the two holes in the tubular strap (105): a first is preferably positioned about 8-16 inches from the first end (108); and, a second is preferably positioned about 28-36 inches from the first end (108). The elastic strap (110) has an un-stretched finished length of about 8-10 inches, is approximately the same width as the tubular strap (105), and stretches a distance in a range of about 5 to 8 inches. The finger-pull (305) is made of 12 gauge solid copper wire and is about 2 inches square.

EXAMPLE 2

Reference to FIG. 7 may help in understanding the method of using this embodiment of the safety strap assembly. A climber (701) first wraps the tubular strap (105) around the tree and threads the opposite end (109) through the oval chain-link (120) between the first end (108) and the elastic-strap end (111). The elastic strap (110) is then attached to the tubular strap (110) in a slidable engagement (710) that cinches the connection into a snug fit around the tree. The climber (701) simultaneously holds to the tubular strap (105) and the finger-pull (305) in one hand. When climbing or descending the climber (701) pulls on the finger-pull (305) to loosen the snug fit and slides the strap up or down with the same hand acting on the finger-pull (305), respectively. The finger-pull releases from its engagement with the nut (321) if the climber (701) falls, which automatically tightens the tubular strap (105) against the tree and prevents the climber's fall to the ground.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

Industrial Applicability

The invention has application to the hunting, tree conservation and industrial-safety industries.

What is claimed is:

1. A safety strap assembly for use by a climber for ascending, remaining secured at height and descending from a tree or pole, the safety strap assembly comprising:

a tubular strap comprising a width, a length, a first end, and an opposite end;

the length adapted to fit around a tree;

the first end adapted to connect to an elastic strap;

the tubular strap defining two holes spaced from the ends and extending though a wall of the tubular strap;

the opposite end configured for attachment to the climber;

a stiffening member slidably fitting within the tubular strap;

a string attached to the stiffening member and extending out from the two holes such that pulling on the string extending from one hole moves the stiffening member in one direction and pulling on the string from the other hole moves the stiffening member in the opposite direction;

an elastic strap comprising:

an elastic-strap end attached to the first end;

a second-elastic-strap end folded back on itself through a coupling, the coupling adapted to connect to the tubular strap in a removable slidable engagement that maintains the tubular strap in a snug fit around the tree; and, a finger-pull adapted to:

provide a hand hold for the climber;

removably engage the first end; and, release from the first end with a force equal to a substantial portion of applied weight of the climber during a fall.

2. The safety strap assembly of claim 1, wherein the coupling comprises:

a chain-loop secured to the second-elastic-strap end; and, a prong offset from the chain-loop and adapted to fit over the tubular strap across the width of the tubular strap forming the slidable engagement between the prong and a portion of the chain-loop.

3. The safety strap assembly of claim 2, further comprising a closable link between the prong and the link connector adapted to prevent inadvertent removal of the elastic strap at the slidable engagement.

4. The safety strap assembly of claim 3, wherein the closable link is spring loaded and biased to a closed position.

5. The safety strap assembly of claim 1, wherein the tubular strap comprises a pliable, nylon webbing.

6. The safety strap assembly of claim 1:

wherein the first end is configured with a fold over to form a connection loop;

the safety strap assembly further comprising an oval chain link, the oval chain link comprising a nut that opens the oval chain link, the nut adapted to be fitted within the connection loop; and, wherein the finger-pull comprises a wire-frame adapted to releasably engage the nut.

* * * * *